US010479380B2

(12) United States Patent
Bramucci et al.

(10) Patent No.: US 10,479,380 B2
(45) Date of Patent: Nov. 19, 2019

(54) HAZARDOUS EVENT ALERT SYSTEMS AND METHODS

(71) Applicant: Westinghouse Air Brake Technologies Corporation, Wilmerding, PA (US)

(72) Inventors: Joshua M. Bramucci, Elkridge, MD (US); Benjamin Henniges, Mt. Airy, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 358 days.

(21) Appl. No.: 15/062,459

(22) Filed: Mar. 7, 2016

(65) Prior Publication Data

US 2017/0253258 A1 Sep. 7, 2017

(51) Int. Cl.

| | |
|---|---|
| ***B61L 23/00*** | (2006.01) |
| ***B61L 15/00*** | (2006.01) |
| ***B61L 25/02*** | (2006.01) |
| ***B61L 27/00*** | (2006.01) |

(52) U.S. Cl.

CPC ..... *B61L 23/00* (2013.01); *B61L 15/009* (2013.01); *B61L 15/0054* (2013.01); *B61L 15/0081* (2013.01); *B61L 25/02* (2013.01); *B61L 27/0005* (2013.01)

(58) Field of Classification Search

CPC ..... B61L 23/00; B61L 15/00; B61L 15/0054; B61L 15/0081; B61L 15/009; B61L 25/02; B61L 27/0005

See application file for complete search history.

(56) References Cited

U.S. PATENT DOCUMENTS

| | | | | |
|---|---|---|---|---|
| 5,987,979 | A * | 11/1999 | Bryan | B61K 9/08 33/1 Q |
| 6,557,476 | B2 * | 5/2003 | Batisse | B60L 9/18 104/289 |
| 8,914,162 | B2 * | 12/2014 | Kernwein | B61K 9/08 701/1 |
| 2002/0027495 | A1 * | 3/2002 | Darby, Jr. | B61L 3/125 340/298 |
| 2003/0205164 | A1 * | 11/2003 | Engle | B61H 13/005 105/404 |
| 2008/0149781 | A1 | 6/2008 | Root et al. | |
| 2013/0254576 | A1 * | 9/2013 | Kodaka | G06F 1/3287 713/324 |

(Continued)

*Primary Examiner* — Jason C Smith

(74) *Attorney, Agent, or Firm* — The Webb Law Firm

(57) ABSTRACT

A hazardous event alert system for a train includes a sensor, a communication device, a positioning system, and a computer. The sensor is positioned on or associated with the train and configured to sense or monitor at least one parameter or condition. The computer is programmed or configured to determine that a hazardous event occurred based at least partially on data generated by the at least one sensor, determine or receive the location or position of the at least a portion of the train from the at least one positioning system, generate a hazardous event notification based at least partially on the at least one condition and the location or position of the at least a portion of the train, and communicate the hazardous event notification to at least one of a back office system and at least one remote server associated with at least one specified entity.

28 Claims, 3 Drawing Sheets

(56) References Cited

U.S. PATENT DOCUMENTS

2013/0334373 A1* 12/2013 Malone, Jr. ..... B61L 23/044
246/2 R
2014/0088802 A1* 3/2014 Knollmann ..... B61L 15/0072
701/20
2014/0131524 A1* 5/2014 Grimm ..... B61L 27/00
246/3
2014/0252174 A1* 9/2014 Melas ..... B61C 17/12
246/187 A
2015/0158507 A1* 6/2015 Flamanc ..... B60T 7/124
104/242
2015/0225002 A1* 8/2015 Branka ..... B61L 23/041
246/120
2015/0291193 A1* 10/2015 Perras ..... B61L 25/025
246/122 R
2015/0302752 A1* 10/2015 Holihan ..... G08G 1/164
246/62
2015/0367862 A1* 12/2015 Ledbetter ..... B61C 5/00
701/19
2016/0039439 A1* 2/2016 Fahmy ..... B61L 27/0088
701/20
2017/0129514 A1* 5/2017 Shubs, Jr. ..... B61L 27/04
2017/0253258 A1* 9/2017 Bramucci ..... B61L 23/00

* cited by examiner

HAZARDOUS EVENT ALERT SYSTEMS AND METHODS

BACKGROUND OF THE INVENTION

Field of the Invention

The present invention relates generally to hazardous event alert systems and methods, and, in particular, hazardous event alert systems and methods for trains.

Description of Related Art

There is a rapidly growing movement to transport more crude oil by rail as production exceeds the capacity of pipelines and existing rail networks. Additional transport by rail has enhanced concern of the potential for catastrophic events, such as train derailments.

The Federal Railroad Administration (FRA) has worked with the Pipelines and Hazardous Materials Safety Administration (PHMSA) to improve the safety of such shipments. The FRA has issued an Order and Safety Advisory changing how hazardous materials are transported. Currently, railroads are required to develop and implement risk assessments and security plans when transporting hazardous materials. The US Department of Transportation has also been working to ensure that first responders are trained to properly handle incidents involving the transportation of hazardous materials.

Despite these efforts, first responders to hazardous events may be unaware of what types of hazardous materials may be present in the event of a derailment or other event. The engineer of the train is responsible to ensure that the crew is safe and to follow the railroad's emergency response plan. In the event of a hazardous event, the engineer would typically contact 911 and a dispatch office to inform them of the event. The dispatch office would then contact other trains on the network to inform them of the event. In such situations, neither the engineer nor the dispatch office has much time available to contact first responders or to provide instruction to those responding to the event.

Thus, there are efforts to improve the safety of such shipments, including development and implementation of risk assessments and security plans for transporting hazardous materials and training of first responders to properly handle incidents involving the transportation of hazardous materials.

SUMMARY OF THE INVENTION

In preferred and non-limiting embodiments or aspects, provided are hazardous event alert systems, computer-implemented hazardous event alerting methods, and computer program products for a train. Preferably, provided are improved systems, methods, and computer program products that overcome certain deficiencies and drawbacks associated with existing hazardous event alert systems, methods, and computer program products.

According to a preferred and non-limiting embodiment or aspect, provided is a hazardous event alert system for a train, the hazardous event alert system comprising: at least one sensor positioned on or associated with the train and configured to sense or monitor at least one parameter or condition; at least one communication device positioned on or associated with the train and programmed or configured to receive, process, and/or transmit data; at least one positioning system programmed or configured to detect a location or position of at least a portion of the train; and at least one computer positioned on or associated with the train and in communication with the at least one sensor, the at least one communication device, and the at least one positioning system, wherein the at least computer is programmed or configured to: determine that a hazardous event occurred based at least partially on data generated by the at least one sensor; determine or receive the location or position of the at least a portion of the train from the at least one positioning system; generate a hazardous event notification based at least partially on the at least one condition and the location or position of the at least a portion of the train; and communicate the hazardous event notification to at least one of a back office system and at least one remote server associated with at least one specified entity.

According to another preferred and non-limiting embodiment or aspect, provided is a computer-implemented hazardous event alerting method for a train having at least one sensor, at least one communication device, at least one positioning system, and at least one processor, the method comprising: detecting at least one parameter or condition associated with a hazardous event with the at least one sensor; detecting a position or location of the train with the at least one positioning system; determining, with the at least one processor, that the hazardous event occurred based at least partially on at least one of the following: determining that a manual confirmation input is received from the operator of the train, determining that a manual confirmation input is not received from the operator of the train within a predetermined time period, determining a communication error between an on-board computer and at least one of an end-of-train computer and the at least one sensor, or any combination thereof; generating a hazardous event notification based at least partially on the at least one condition and the position or location of the train; and transmitting the hazardous event notification to at least one remote server.

According to a further preferred and non-limiting embodiment or aspect, provided is a computer program product comprising at least one non-transitory computer-readable medium including program instructions that, when executed by at least one computer including at least one processor, causes the at least one computer to: detect at least one parameter or condition associated with a hazardous event with at least one sensor; determine a position or location of the train with at least one positioning system; determine that the hazardous event occurred based at least partially on at least one of the following: (a) determining that a manual confirmation input is received from the operator of the train, (b) determining that a manual confirmation input is not received from the operator of the train within a predetermined time period, (c) determining a communication error between an on-board computer and at least one of an end-of-train computer and the at least one sensor, or (d) any combination thereof; generate a hazardous event notification based at least partially on the at least one parameter or condition and the position or location of the train; and transmit the hazardous event notification to at least one remote server.

According to a further preferred and non-limiting embodiment or aspect, provided is a system for generating a hazardous event notification on a train, comprising: (a) an end-of-train computer in communication with at least one sensor, the end-of-train computer programmed or configured to: (i) detect, with the at least one sensor, at least one parameter or condition associated with a hazardous event; and (ii) transmit an alert to an on-board computer in response to detecting the at least one parameter or condition; and (b) the on-board computer programmed or configured to: (i) receive the alert from the end-of-train computer; (ii) display an indication of the alert to an operator of the train in response to receiving the alert; and (iii) receive, from the operator of the train, an input confirming the alert or cancelling the alert; wherein at least one of the end-of-train computer and the on-board computer is further programmed or configured to: (i) determine that the hazardous event occurred in response to: determining that the input confirmed the alert, determining that the input is not received within a predetermined time period, or determining that the end-of-train computer did not receive a confirmation from the on-board computer after transmitting the alert; (ii) generate a hazardous event notification based at least partially on the at least one condition and a location or position of the train when the at least one condition is detected; and (iii) transmit the hazardous event notification to at least one remote server.

According to a further non-limiting embodiment or aspect, provided is a hazardous event alert system including: at least one sensor positioned on or associated with the train and configured to sense or determine at least one condition associated with a hazardous event; at least one communication device positioned on or associated with the train and programmed or configured to receive, process, and/or transmit data; at least one positioning system programmed or configured to sense or determine a location or position of at least a portion of the train; and at least one computer positioned on or associated with the train and in direct or indirect communication with the at least one sensor, the at least one communication device, and the at least one positioning system. The at least one computer may be programmed or configured to: generate or receive a notification based at least partially on the at least one condition sensed or determined by the at least one sensor; determine or receive a location or position of at least a portion of the train based at least partially on the location or position sensed or determined by the at least one positioning system; and directly or indirectly communicate a notification of a hazardous event to at least one of the following: an on-board computer located in or associated with the at least one locomotive of the train; an end-of-train computer located in or associated with at least one railcar of the train; a remote server associated with a specified entity; or any combination thereof.

According to a further non-limiting embodiment or aspect, provided is a computer-implemented hazardous event alerting method for a train having at least one sensor, at least one communication device, at least one positioning system, and at least one computer. The method may include: sensing or determining, by the at least one sensor, at least one condition associated with a hazardous event; sensing or determining, by the at least one positioning system, a location or position of at least a portion of the train; generating or receiving, by the at least one computer, a notification based at least partially on the at least one condition sensed or determined by the at least one sensor; and directly or indirectly communicating, by the at least one communication device, a notification of a hazardous event to at least one of the following: an on-board computer located in or associated with the at least one locomotive of the train; an end-of-train computer located in or associated with at least one railcar of the train; a remote server associated with a specified entity; or any combination thereof.

According to a further non-limiting embodiment or aspect, provided is a computer program product comprising at least one non-transitory computer-readable medium including program instructions that, when executed by at least one computer including at least one processor, causes the at least one computer to: generate or receive a notification based at least partially on the at least one condition associated with a hazardous event; determine or receive a location or position of at least a portion of the train; and directly or indirectly communicate a notification of a hazardous event to at least one of the following: an on-board computer located in or associated with the at least one locomotive of the train; an end-of-train computer located in or associated with at least one railcar of the train; a remote server associated with a specified entity; or any combination thereof.

According to a further non-limiting embodiment or aspect, provided is a hazardous event alert system for a train. The hazardous event alert system may include: means for sensing or determining at least one condition associated with a hazardous event; means for receiving, processing, and/or transmitting data; means for sensing or determining a location or position of at least a portion of the train; and means for generating or receiving a notification based at least partially on the at least one condition sensed or determined and for directly or indirectly communicating a notification of a hazardous event to at least one of the following: an on-board computer located in or associated with the at least one locomotive of the train; an end-of-train computer located in or associated with at least one railcar of the train; a remote server associated with a specified entity; or any combination thereof.

Further preferred and non-limiting embodiments or aspects are set forth in the following numbered clauses.

Clause 1: A hazardous event alert system for a train, the hazardous event alert system comprising: at least one sensor positioned on or associated with the train and configured to sense or monitor at least one parameter or condition; at least one communication device positioned on or associated with the train and programmed or configured to receive, process, and/or transmit data; at least one positioning system programmed or configured to detect a location or position of at least a portion of the train; and at least one computer positioned on or associated with the train and in communication with the at least one sensor, the at least one communication device, and the at least one positioning system, wherein the at least one computer is programmed or configured to: determine that a hazardous event occurred based at least partially on data generated by the at least one sensor; determine or receive the location or position of the at least a portion of the train from the at least one positioning system; generate a hazardous event notification based at least partially on the at least one condition and the location or position of the at least a portion of the train; and communicate the hazardous event notification to at least one of a back office system and at least one remote server associated with at least one specified entity.

Clause 2: The hazardous event alert system of clause 1, wherein the at least one specified entity includes at least one of the following: a federal government authority; a state government authority; a local government authority; a maintenance entity; a medical entity; a search and rescue entity; a state police; a local police; an agency related to homeland security; or any combination thereof.

Clause 3: The hazardous event alert system of clauses 1 or 2, wherein the at least one sensor is at least one of the following: a rotational sensor; a gyroscope; an accelerometer; a pressure sensor; or any combination thereof.

Clause 4: The hazardous event alert system of any of clauses 1-3, wherein the at least one computer comprises: an end-of-train computer located in or on the train and in communication with the at least one sensor; and an on-board computer located in or associated with a locomotive of the train and in communication with the at least one end-of-train computer.

Clause 5: The hazardous event alert system any of clauses 1-4, wherein the at least one sensor comprises a pressure sensor adapted to monitor brake pipe pressure, and wherein the end-of-train computer is programmed or configured to determine that the at least one condition has occurred based on the brake pipe pressure.

Clause 6: The hazardous event alert system of any of clauses 1-5, wherein at least one of an end-of-train computer and the at least one sensor is programmed or configured to transmit an alert to an on-board computer in response to the at least one parameter or condition being detected, and wherein the at least one on-board computer is programmed or configured to: display an alert to an operator of the train in response to the at least one condition being detected; and receive an input from the operator confirming or invalidating the occurrence of the hazardous event.

Clause 7: The hazardous event alert system of any of clauses 1-6, wherein at least one of the following: the end-of-train computer, the on-board computer, the at least one sensor, or any combination thereof is further programmed or configured to communicate the hazardous event notification to the at least one remote server associated with the at least one specified entity in response to determining at least one of the following: (a) that the input is not received by the on-board computer within a predetermined time period; (b) that the input confirms the occurrence of the hazardous event; (c) that a communication error occurred between the on-board computer and at least one of the end-of-train computer and the at least one sensor; or (d) any combination thereof.

Clause 8: The hazardous event alert system of clause 6, wherein the at least one computer is further programmed or configured to communicate the hazardous event notification to the back office system but not the at least one remote server associated with the at least one specified entity in response to determining that the input invalidates the occurrence of the hazardous event.

Clause 9: The hazardous event alert system of any of clauses 1-8, wherein the at least one computer is further programmed or configured to identify or receive identification of the at least one specified entity to receive the hazardous event notification based at least partially on at least one of the following: the location or position of an occurrence of a hazardous event, a category of the hazardous event, a severity of the hazardous event, an identity of a hazardous material being transported by the train, or any combination thereof.

Clause 10: The hazardous event alert system of any of clauses 1-9, wherein the at least one sensor comprises: a sensing device configured to sense or monitor the at least one parameter or condition; and a communications device configured to transmit data associated with the at least one parameter or condition to at least one of the at least one computer and at least one other sensor.

Clause 11: The hazardous event alert system of any of clauses 1-10, wherein the at least one sensor is removably attachable to at least a portion of at least one railcar of the train.

Clause 12: A computer-implemented hazardous event alerting method for a train having at least one sensor, at least one communication device, at least one positioning system, and at least one processor, the method comprising: detecting at least one parameter or condition associated with a hazardous event with the at least one sensor; detecting a position or location of the train with the at least one positioning system; determining, with the at least one processor, that the hazardous event occurred based at least partially on at least one of the following: determining that a manual confirmation input is received from an operator of the train, determining that a manual confirmation input is not received from the operator of the train within a predetermined time period, determining a communication error between an on-board computer and at least one of an end-of-train computer and the at least one sensor, or any combination thereof; generating a hazardous event notification based at least partially on the at least one condition and the position or location of the train; and transmitting the hazardous event notification to at least one remote server.

Clause 13: The computer-implemented hazardous event alerting method of clause 12, wherein the hazardous event is a train derailment.

Clause 14: The computer-implemented hazardous event alerting method of clause 12 or 13, further comprising transmitting an alert from at least one of the end-of-train computer and the at least one sensor to the on-board computer in response to detecting the at least one condition, wherein the communication error is determined if a confirmation message is not received from the on-board computer by at least one of the end-of-train computer and the at least one sensor in response to the alert.

Clause 15: The computer-implemented hazardous event alerting method of any of clauses 12-14, wherein the at least one sensor is at least one of the following: a rotational sensor; a gyroscope; an accelerometer; a pressure sensor; or any combination thereof.

Clause 16: The computer-implemented hazardous event alerting method of any of clauses 12-15, wherein the at least one sensor comprises a pressure sensor adapted to monitor brake pipe pressure, and wherein the at least one parameter or condition is detected based on the brake pipe pressure.

Clause 17: The computer-implemented hazardous event alerting method of any of clauses 12-16, wherein the at least one remote server comprises a back office system and at least one remote server associated with at least one specified entity.

Clause 18: The computer-implemented hazardous event alerting method of any of clauses 12-17, further comprising identifying the at least one specified entity based at least partially on at least one of the following: the location or position of a hazardous event, a category of the hazardous event, a severity of the hazardous event, an identity of a hazardous material being transported by the train, or any combination thereof.

Clause 19: The computer-implemented hazardous event alerting method of any of clauses 12-18, wherein the end-of-train computer monitors the at least one parameter or condition associated with the hazardous event and detects the at least one parameter or condition, wherein the on-board computer displays the alert to the operator of the train, and wherein at least one of the following: the end-of-train computer, the on-board computer, the at least one sensor, or any combination thereof, determines if the operator confirmed or cancelled the alert, generates the hazardous event notification, and transmits the hazardous event notification.

Clause 20: A computer program product comprising at least one non-transitory computer-readable medium including program instructions that, when executed by at least one computer including at least one processor, causes the at least one computer to: detect at least one parameter or condition associated with a hazardous event with at least one sensor located on or in a train; determine a position or location of the train with at least one positioning system; determine that the hazardous event occurred based at least partially on at least one of the following: (a) determining that a manual confirmation input is received from an operator of the train, (b) determining that a manual confirmation input is not received from the operator of the train within a predetermined time period, or (c) determining a communication error between an on-board computer and at least one of an end-of-train computer and the at least one sensor, or any combination thereof; generate a hazardous event notification based at least partially on the at least one parameter or condition and the position or location of the train; and transmit the hazardous event notification to at least one remote server.

Clause 21: The computer program product of clause 20, wherein the hazardous event is a train derailment.

Clause 22: The computer program product of clause 20 or 21, wherein the program instructions, when executed by the at least one computer, further cause the at least one computer to transmit an alert from at least one of the at least one sensor and the end-of-train computer to the on-board computer in response to detecting the at least one parameter or condition, wherein the communication error is determined if a confirmation message is not received by the at least one of the at least one sensor and the end-of-train computer from the on-board computer in response to the alert.

Clause 23: The computer program product of any of clauses 20-22, wherein the at least one sensor is at least one of the following: a rotational sensor; a gyroscope; an accelerometer; a pressure sensor; or any combination thereof.

Clause 24: The computer program product of any of clauses 20-23, wherein the at least one sensor comprises a pressure sensor adapted to monitor brake pipe pressure, and wherein the at least one condition is detected based on the brake pipe pressure.

Clause 25: The computer program product of any of clauses 20-24, wherein the at least one remote server comprises a back office system and at least one remote server associated with at least one specified entity.

Clause 26: The computer program product of any of clauses 20-25, wherein the program instructions, when executed by the at least one computer, further cause the at least one computer to identify the at least one specified entity based at least partially on at least one of the following: the location or position of a hazardous event, a category of the hazardous event, a severity of the hazardous event, an identity of a hazardous material being transported by the train, or any combination thereof.

Clause 27: A system for generating a hazardous event notification on a train, comprising: (a) an end-of-train computer in communication with at least one sensor, the end-of-train computer programmed or configured to: (i) detect, with the at least one sensor, at least one parameter or condition associated with a hazardous event; and (ii) transmit an alert to an on-board computer in response to detecting the at least one parameter or condition; and (b) the on-board computer programmed or configured to: (i) receive the alert from the end-of-train computer; (ii) display an indication of the alert to an operator of the train in response to receiving the alert; (iii) receive, from the operator of the train, an input confirming the alert or cancelling the alert; wherein at least one of the end-of-train computer and the on-board computer is further programmed or configured to: (i) determine that the hazardous event occurred in response to: determining that the input confirmed the alert, determining that the input is not received within a predetermined time period, or determining that the end-of-train computer did not receive a confirmation from the on-board computer after transmitting the alert; (ii) generate the hazardous event notification based at least partially on the at least one condition and a location or position of the train when the at least one condition is detected; and (iii) transmit the hazardous event notification to at least one remote server.

Clause 28: The system of clause 27, wherein the at least one remote server comprises at least one server associated with a governmental or regulatory agency and a back office system, and wherein the hazardous event notification is transmitted to the back office system but not the at least one server associated with the governmental or regulatory agency if the input cancels the alert.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE INVENTION

Figure 1:
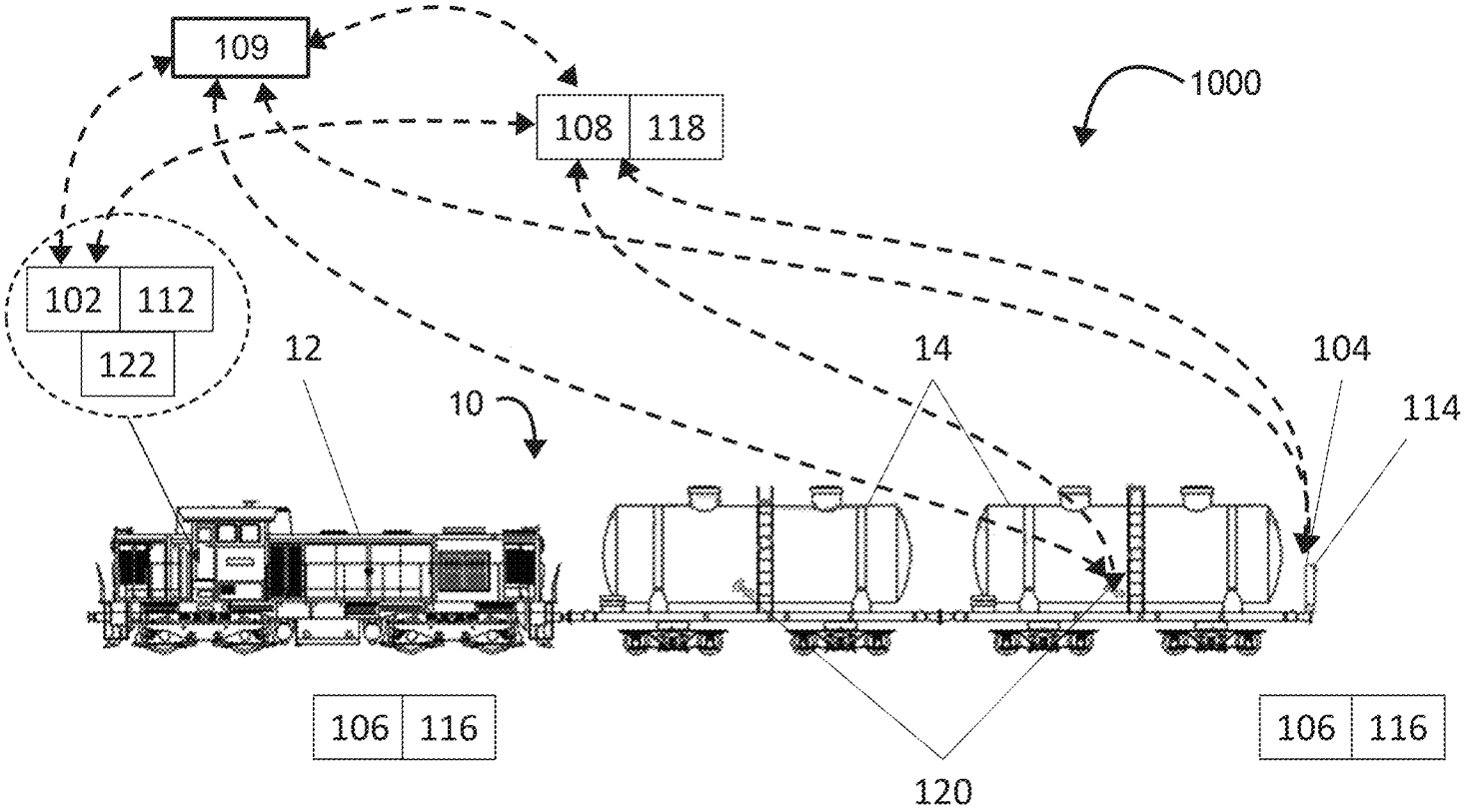
FIG. 1 illustrates a train and a hazardous event alert system according to a preferred and non-limiting embodiment or aspect.

It is to be understood that the invention may assume various alternative variations and step sequences, except where expressly specified to the contrary. It is also to be understood that the specific products, systems, and processes illustrated in the attached drawings, and described in the following specification, are simply exemplary embodiments of the invention. Hence, specific dimensions and other physical characteristics related to the embodiments disclosed herein are not to be considered as limiting. As used herein, the singular form of "a", "an", and "the" include plural referents unless the context clearly dictates otherwise.

As used herein, the terms "communication" and "communicate" refer to the receipt, transmission, or transfer of one or more signals, messages, commands, or other type of data. For one unit or device to be in communication with another unit or device means that the one unit or device is able to receive data from and/or transmit data to the other unit or device. A communication may use a direct or indirect connection and may be wired and/or wireless in nature. Additionally, two units or devices may be in communication with each other even though the data transmitted may be modified, processed, routed, etc., between the first and second unit or device. For example, a first unit may be in communication with a second unit even though the first unit passively receives data and does not actively transmit data to the second unit. As another example, a first unit may be in communication with a second unit if an intermediary unit processes data from one unit and transmits processed data to the second unit. It will be appreciated that numerous other arrangements are possible. Any known electronic communication protocols and/or algorithms may be used such as, for example, TCP/IP (including HTTP and other protocols), WLAN (including 802.11 and other radio frequency-based protocols and methods), analog transmissions, Global System for Mobile Communications (GSM), and/or the like.

In a preferred and non-limiting embodiment or aspect, a hazardous event alert system for a train may include a sensor, a communication device, a positioning system, and one or more computers. In a preferred and non-limiting embodiment or aspect, the sensor may be positioned on or associated with the train. In a preferred and non-limiting embodiment or aspect, the sensor may be configured to sense or determine a parameter or condition associated with a hazardous event. For example, a parameter or condition may include an acceleration event, a brake pipe pressure, a vibration, a tilt of a train and/or railcar, a speed, a temperature, and/or other like conditions or parameters associated with a hazardous event such as a derailment. In a preferred and non-limiting embodiment or aspect, the communication device may be positioned on or associated with the train. In a preferred and non-limiting embodiment or aspect, the communication device may be programmed or configured to receive, process, and/or transmit data. In a preferred and non-limiting embodiment or aspect, the positioning system may be programmed or configured to sense or determine a location or position of a portion of the train. In a preferred and non-limiting embodiment or aspect, the one or more computers may be positioned on or associated with the train. In a preferred and non-limiting embodiment or aspect, the one or more computers may be in direct or indirect communication with the sensor, the communication device, and the positioning system. In a preferred and non-limiting embodiment or aspect, the one or more computers may be programmed or configured to generate or receive a notification based at least partially on the parameter or condition sensed or determined by the sensor. In a preferred and non-limiting embodiment or aspect, the one or more computers may be programmed or configured to determine or receive a location or position of at least a portion of the train based at least partially on the location or position sensed or determined by the at least one positioning system. In a preferred and non-limiting embodiment or aspect, the one or more computers may be programmed or configured to directly or indirectly communicate a notification of a hazardous event between the computers, to a remote server associated with a specified entity, to a back office system (BOS), or any combination thereof. In preferred and non-limiting embodiments or aspects, the one or more computers may include an end-of-train computer and an on-board computer.

FIG. 1 illustrates a preferred and non-limiting embodiment or aspect of a hazardous event alert system 1000. The system 1000 includes a train 10 having a locomotive 12 and one or more railcars 14. The train 10 may include an on-board computer 102 located in or associated with the locomotive 12. It will be appreciated that the on-board computer 102 may also be located elsewhere on the train 10. In a preferred and non-limiting embodiment or aspect, the on-board computer 102 may form part of, may include, or may be connected to another device and/or system with a separate function in the locomotive 12, such as a Positive Train Control (PTC) system, a head-end-unit (HEU) system, a train management computer, and/or a locomotive cab unit system. In another preferred and non-limiting embodiment or aspect, the on-board computer 102 may be a separate device and/or system. By way of a non-limiting example, the separate device and/or system may be a stationary device and/or system or a mobile device and/or system, such as an application computing device or a mobile device, such as a smartphone, laptop, or tablet computer.

In a preferred and non-limiting embodiment or aspect, the on-board computer 102 may be in direct and/or indirect communication with one or more end-of-train computers 104, one or more wayside computers 106, one or more remote servers 108, 109, one or more sensors 120, and/or one or more positioning devices 122. By way of a non-limiting example, the on-board computer 102 may directly and/or indirectly communicate via one or more communication devices 112. In a preferred and non-limiting embodiment or aspect, the on-board computer 102 is in communication with an end-of-train computer 104 via a trainline running from the lead to the rear of the train. The sensors 120 may be in communication with the end-of-train computer 104, on-board computer 102, and/or remote servers 108, 109. It will be appreciated that various forms of wired and wireless communication may be used.

In a preferred and non-limiting embodiment or aspect, the on-board computer 102 may directly and/or indirectly receive a notification (e.g., an alert or other message) concerning the occurrence of one or more parameters or conditions sensed or determined from a sensor 120, and/or the on-board computer 102 may directly or indirectly receive a notification concerning the occurrence of a parameter or condition sensed or determined by the sensor 120 from an end-of-train computer 104 and/or a wayside computer 106. In preferred and non-limiting embodiments or aspects, the on-board computer 102 may directly or indirectly confirm receipt of a notification directly or indirectly received from the end-of-train computer 104 and/or the wayside computer 106.

In a preferred and non-limiting embodiment or aspect, a notification concerning an occurrence of a parameter or condition sensed or determined by the sensor 120 may be directly or indirectly received by the on-board computer 102, and the on-board computer 102 may directly or indirectly communicate a hazardous event notification to a remote server 108 associated with a specified entity associated with a governmental agency, regulatory agency, or some other authority or entity, and/or a remote server 109 of a back office system (BOS) 109 (e.g., a central office associated with the train 10). In preferred and non-limiting embodiments or aspects, the end-of-train computer 104 may also or alternatively communicate a hazardous event notification to the remote server 108 and/or server 109.

By way of a non-limiting example, the on-board computer 102 may directly or indirectly communicate a hazardous event notification to a remote server 108 associated with a specified entity other than the BOS associated with the train 10, and the on-board computer 102 may also directly or indirectly communicate to such specified entity by other methods, including but not limited to, phone calls, text messages, push notifications, and/or the like. The end-of-train computer 104 may communicate with the remote server 108 and/or back office system instead of or in addition to the on-board computer 102, or when the end-of-train computer 104 is out of communication with the on-board computer 102. It will be appreciated that other variations are possible.

With continued reference to FIG. 1, the on-board computer 102 and/or end-of-train computer 104 may directly or indirectly communicate the notification of the hazardous event to a the remote server 109 of the BOS associated with the train 10, and the remote server 109 may be configured to directly or indirectly communicate a notification of the hazardous event to one or more other remote servers 108 associated with one or more specified entities.

According to a non-limiting embodiment or aspect, the remote server 108 of the specified entity may be selectively determined based on the circumstances of the hazardous event. By way of a non-limiting example, the on-board computer 102 and/or end-of-train computer 104 may directly or indirectly communicate a notification of the hazardous event to a remote server 108 associated with a specified entity other than the central office associated with the train 10 in addition to or instead of directly or indirectly communicating a notification of the hazardous event to a remote server 109 of the BOS associated with the train 10.

In a preferred and non-limiting embodiment or aspect, a notification of a hazardous event communicated by the on-board computer 102 may push an alert to users and first responders who have an alert application installed on their mobile device. The alert may contain a location of the event, a material transported, an amount of material, media (e.g., photographs, images, and/or video), and/or recommended actions to take in response to the hazardous event.

In a preferred and non-limiting embodiment or aspect, a notification of the hazardous event communicated by the on-board computer 102 and/or end-of-train computer 104 may include audio and/or video information, such as audio and/or video information received via an input device associated with the on-board computer 102, end-of-train computer 104, or a mobile device. As an example, the audio and/or video information may be captured by a camera and/or microphone in communication with the on-board computer 102 and/or end-of-train computer 104, or by an operator of the train 10 or crewmember with a mobile device having a camera and/or microphone. One such system and apparatus for collecting visual data is described in U.S. Pat. No. 9,083,861 to Haas et al., entitled "Visual Data Collection System for a Train," the disclosure of which is hereby incorporated by reference in its entirety.

In preferred and non-limiting embodiments or aspects, a notification of the hazardous event communicated by the on-board computer 102 and/or end-of-train computer 104 may result in a track restriction so that other trains and/or operators of such trains can be notified of the incident and take appropriate actions.

In a preferred and non-limiting embodiment or aspect, the on-board computer 102 and/or end-of-train computer 104 may directly or indirectly communicate the notification of the hazardous event before or after validation or invalidation, or may directly or indirectly communicate the notification without validation or invalidation. For example, in response to detecting a parameter or condition, an operator of the train 10 may be presented with an indication of the alert with options to validate (e.g., confirm) or invalidate (e.g., cancel) the alert. By way of a non-limiting example, the on-board computer 102 may directly or indirectly communicate the notification of the hazardous event to a remote server 109 associated with the back office system before validation or invalidation, and may communicate the notification to the remote server 108 associated with a specified entity after the alert is verified or after a predetermined time period elapses without any input being received from the operator of the train 10. It will be appreciated that the notification may be communicated to the remote server 109 associated with the back office system after validation or the expiration of the predetermined time period.

By way of non-limiting example, the on-board computer 102 and/or end-of-train computer 104 may directly or indirectly communicate the notification of the hazardous event to a remote server 109 of the BOS associated with the train 10 before validation or invalidation, and may again directly or indirectly communicate the notification of the validated hazardous event to the remote server 109 of the BOS and/or to another remote server 108 associated with a specified entity other than the central office associated with the train 10. By way of another non-limiting example, the on-board computer 102 may wait for validation or invalidation before directly or indirectly communicating the notification of the hazardous event to a remote server 108 associated with a specified entity and the remote server 109 of the back office system associated with the train 10 and/or to another remote server 108 associated with another specified entity.

In preferred and non-limiting embodiments or aspects, after invalidation of the occurrence of the hazardous event, the on-board computer 102 and/or end-of-train computer 104 may still directly or indirectly communicate the notification of the invalidated hazardous event to the remote server 109 of the back office system associated with the train 10 for recordation or other purposes.

As explained above, in the case that the occurrence of a hazardous event is neither validated nor invalidated within a predetermined time period, the on-board computer 102 and/or end-of-train computer 104 according to a preferred and non-limiting embodiment or aspect may directly or indirectly communicate the notification of the hazardous event to a remote server 109 of the back office system associated with the train 10 and the remote server 108 associated with a specified entity other than the back office system associated with the train 10.

In a preferred and non-limiting embodiment or aspect, the on-board computer 102 and/or end-of-train computer 104 may directly or indirectly communicate the notification of the hazardous event to a remote server 109 of a back office system associated with the train 10 before validation or invalidation, and after the event is neither validated nor invalidated, the on-board computer 102 may directly or indirectly communicate the notification of the unconfirmed hazardous event to the remote server 109 of the back office system associated with the train 10 and/or to another remote server 108 associated with another specified entity.

For validation, the on-board computer 102 and/or end-of-train computer 104 may validate or invalidate the occurrence of a hazardous event communicating with an engineer of the train 10 and/or by relying on other information. By way of a non-limiting example, a notification of at least one parameter or condition sensed or determined by a second sensor 120 may be used to validate the at least one parameter or condition sensed or determined by a first sensor 120.

In the case of validating or invalidating the occurrence of the hazardous event based on communications with an engineer of the train 10, the on-board computer 102 may include and/or be in communication with one or more input devices and/or one or more output devices. An input device may include but is not limited to a keyboard, mouse, joystick, audio input, and/or video input. An input device may include a stationary input device and/or a mobile input device. By way of another non-limiting example, the stationary input device may include a mounted microphone and/or mounted camera. By way of a non-limiting example, the mobile input device may include a handheld phone and/or handheld camera. The input device may include a stationary input device and/or a mobile input device. By way of a non-limiting example, the static and/or mobile output device may include an audio output device, such as a speaker and/or a display, and/or a video output device, such as a handheld phone or a handheld display. By way of a non-limiting example, the input device and the output device may be the same or separate devices and/or systems.

In a preferred and non-limiting embodiment or aspect, the on-board computer 102 may validate or invalidate the occurrence of the hazardous event based on communications with an engineer of the train 10. By way of a non-limiting example, the on-board computer 102 may validate or invalidate the occurrence of the hazardous event by generating a prompt to an engineer of the train 10 via the output device. The on-board computer 102 may further request validation or invalidation from the engineer of the occurrence of a hazardous event via the input device. If validation of the occurrence of the hazardous event is received via the input device, then the on-board computer 102 may directly or indirectly communicate a notification of a hazardous event to one or more remote servers 108, 109 as described above. If the occurrence of the hazardous event is invalidated, then the on-board computer 102 may or may not directly or indirectly communicate a notification of an invalidated hazardous event to the remote servers 108, 109 and may, in some examples, communicate the notification only to the remote server 109 of the back office system.

If no validation or invalidation of the occurrence of the hazardous event is received via the input device, which may indicate the unavailability of the engineer, then the on-board computer 102 may directly or indirectly communicate a notification of a hazardous event to the remote servers 108, 109 after predetermined conditions are met, such as a predetermined amount of time for the engineer to validate or invalidate the occurrence of the hazardous event. In a preferred and non-limiting embodiment or aspect, the on-board computer 102 may determine the specified entity to be contacted based on whether the occurrence of the hazard is validated, invalidated, or unconfirmed.

In preferred and non-limiting embodiments or aspects, the on-board computer 102 may receive a notification of an occurrence of a hazardous event from an engineer of the train 10 via an input device with or without a parameter or condition being previously sensed or determined by a sensor 120. In this case, the on-board computer 102 may directly or indirectly communicate the notification of the hazardous event to a remote server 109 of the back office system associated with the train 10 and/or may directly or indirectly communicate the notification of the hazardous event to a remote server 108 of another specified entity.

In a preferred and non-limiting embodiment or aspect, the on-board computer 102 may include a database of hazardous event categories. By way of a non-limiting example, the hazardous event categories may include any hazardous event category that is required, encouraged, and/or accepted by a specified entity, such as a federal government authority, a state government authority, a local government authority, a central office associated with the train, another train, a central office associated with another train, a maintenance entity, a medical entity, a search and rescue entity, a state police, a local police, an agency related to homeland security, or any combination thereof. The hazardous event categories may preferably include but are not limited to a category for a train collision event and/or a category for a train derailment event. In a preferred and non-limiting embodiment or aspect, the on-board computer 102 may determine the specified entity to be contacted based on the identity of the hazardous event.

In non-limiting embodiments or aspects, the identity of the hazardous event may be sent to the remote server 108 with the notification of the hazardous event, or the identity of the hazardous event may be sent separately.

In preferred and non-limiting embodiments or aspects, the on-board computer 102 may include a database of predetermined hazardous event severity categories. By way of a non-limiting example, the severity categories may include any severity category that is required, encouraged, and/or accepted by a specified entity, such as a federal government authority, a state government authority, a local government authority, a central office associated with the train, another train, a central office associated with another train, a maintenance entity, a medical entity, a search and rescue entity, a state police, a local police, an agency related to homeland security, or any combination thereof. For example, a severity category may be based on a number of railcars affected by the hazardous event, a location of the hazardous event, a type of track at the location of the hazardous event, a grade of the land at the location of the hazardous event, and/or a proximity to persons and/or structures potentially affected at the location of the hazardous event. For example, severity categories may be based in part on a number of railcars 14 affected by the hazardous event, which may be determined by a number of sensors 120 sensing or determining an at least one parameter or condition associated with a hazardous event. In another preferred and non-limiting embodiment or aspect, severity categories may be based in part on whether a railcar 14 remains upright, such as after derailment or collision, which may be determined from an at least one parameter or condition sensed by a sensor 120. In a preferred and non-limiting embodiment or aspect, the on-board computer 102 may determine a specified entity to be contacted based on the severity of the hazardous event.

In preferred and non-limiting embodiments or aspects, the severity of the hazardous event may be sent to the remote server 108 with the notification of the hazardous event, or the severity of the hazardous event may be sent separately.

In preferred and non-limiting embodiments or aspects, the on-board computer 102 and/or end-of-train computer 104 may receive location data from the positioning device 122, which may or may not be located in or associated with the locomotive 12. In a preferred and non-limiting embodiment or aspect, the on-board computer 102 and/or end-of-train computer 104 may determine the specified entity to be contacted based on the location of the occurrence of the hazardous event. In another preferred and non-limiting embodiment or aspect, the on-board computer 102 and/or end-of-train computer 104 may directly or indirectly communicate the location of the train 10 and/or the occurrence of the hazardous event to the remote servers 108, 109. In preferred and non-limiting embodiments or aspects, the location data may be sent to the remote servers 108, 109 with the notification of the hazardous event, or the location data may be sent separately.

In a preferred and non-limiting embodiment or aspect, the on-board computer 102 and/or end-of-train computer 104 may include a database of pre-determined communications to be made in the event of a hazardous event. The database of pre-determined communications to be made may include any communication that is required, encouraged, and/or accepted by a specified entity, such as a federal government authority, a state government authority, a local government authority, a central office associated with the train, another train, a central office associated with another train, a maintenance entity, a medical entity, a search and rescue entity, a state police, a local police, an agency related to homeland security, or any combination thereof. In a preferred and non-limiting embodiment or aspect, the database of pre-determined communications may include contact information for railroads and/or first responders.

In a preferred and non-limiting embodiment or aspect, the database of pre-determined communications may predetermine the specific entities to be contacted based on one or more circumstances related to the hazardous event. The one or more circumstances may include, but is not limited to, the category of the hazard event, the severity of the hazardous event, and/or the location of the hazardous event.

In a preferred and non-limiting embodiment or aspect, the on-board computer 102 and/or end-of-train computer 104 may include an event log in the form of a data storage device and/or system. The event log may record the occurrence of one or more parameters or conditions sensed or determined by a sensor 120, one or more notifications based on one or more parameters or conditions sensed or determined by the sensor 120, one or more validated hazardous events, one or more invalidated hazardous events, and/or one or more notifications of hazardous events received from an engineer of the train 10 via an input device, but the event log is not limited thereto.

In a preferred and non-limiting embodiment or aspect, the on-board computer 102 and/or end-of-train computer 104 may include a materials storage log in the form of a data storage device and/or system. The materials storage log may record the type of hazardous materials being transported, how much material is being transported, and/or how to properly respond to the hazardous event for the given hazardous material, but at least a part of the materials storage log is not limited thereto. In a preferred and non-limiting embodiment or aspect, the materials storage data may be sent to the remote server 108 with the notification of the hazardous event or a portion of the materials storage data may be sent separately.

In a preferred and non-limiting embodiment or aspect, the end-of-train computer 104 may form part of, may include, or may be connected to another device and/or system located in or associated with the railcar 14. By way of a non-limiting example, another device and/or system may include a smart end-of-train device that includes a flashing rear-end device, a device and/or system that monitors brake line pressure, a device and/or system that monitors for accidental separation of the train, and/or a device and/or system that transmits data to the locomotive 12. In another preferred and non-limiting embodiment or aspect, the end-of-train computer 104 may be a separate device and/or system.

In a preferred and non-limiting embodiment or aspect, the end-of-train computer 104 may be in direct or indirect communication with one or more on-board computers 102, one or more wayside computers 106, one or more remote servers 108, one or more positioning devices 112, and/or one or more sensors 120. In a preferred and non-limiting embodiment or aspect, the end-of-train computer 104 may directly or indirectly communicate via one or more communication devices 114. In a preferred and non-limiting embodiment or aspect, the end-of-train computer 104 may directly and/or indirectly receive a notification concerning the occurrence of a parameter or condition sensed or determined from a sensor 120. In the case that a notification concerning an occurrence of a parameter or condition sensed or determined by the sensor 120 may be directly or indirectly received by the end-of-train computer 104, the end-of-train computer 104 may, according to a preferred and non-limiting embodiment or aspect, directly or indirectly communicate a hazardous event notification to an on-board computer 102, to a wayside computer 106, and/or to a remote server 108 associated with a specified entity.

In the case that the end-of-train computer 104 directly or indirectly communicates the notification of the hazardous event to the on-board computer 102, the end-of-train computer 104 may directly or indirectly receive confirmation of receipt of the notification directly or indirectly communicated from the end-of-train computer 104 to the on-board computer 102. By way of a non-limiting example, the end-of-train computer 104 may receive the confirmation of receipt after communicating a request for a confirmation of receipt of the notification to the on-board computer 102. By way of another non-limiting example, the end-of-train computer 104 may receive the confirmation of receipt without or before communicating a request for a confirmation of receipt of the notification to the on-board computer 102.

If the end-of-train computer 104 does not receive confirmation of receipt of the notification of the hazardous event directly or indirectly communicated from the end-of-train computer 104 to the on-board computer 102, which may result due to the unavailability of the engineer, the end-of-train computer 104 may directly or indirectly communicate a hazardous event notification to a remote server 108 associated with a specified entity after predetermined conditions are met, such as a predetermined amount of time for the on-board computer 102 to confirm receipt of the notification of the hazardous event.

In a preferred and non-limiting embodiment or aspect, the end-of-train computer 104 may directly or indirectly communicate a hazardous event notification to a remote server 108 associated with a specified entity before or without waiting to receive confirmation of receipt of the notification of the hazardous event directly or indirectly communicated from the end-of-train computer 104 to the on-board computer 102. In a preferred and non-limiting embodiment or aspect, a notification of a hazardous event communicated by the end-of-train computer 104 may push an alert to users and first responders who have an alert application installed on their mobile device. The alert may contain a location of the event, a material transported, an amount of material, and/or recommended actions to take in response to the hazardous event.

In a preferred and non-limiting embodiment or aspect, the end-of-train computer 104 may receive location data from the positioning device 122, which may or may not be located in or associated with the at least one railcar 14 of the end-of-train computer 104. In an additional preferred and non-limiting embodiment or aspect, the end-of-train computer 104 may directly or indirectly communicate the location of the train 10 and/or the occurrence of the hazardous event to the on-board computer 102, to a wayside computer 106, and/or to a remote server 108, 109. In a preferred and non-limiting embodiment or aspect, the location data may be sent to the on-board computer 102, the wayside computer 106, and/or the remote server 108 with the notification of the hazardous event. In another preferred and non-limiting embodiment or aspect, the location data may be sent to the on-board computer 102, the wayside computer 106, and/or the remote server(s) 108, 109 separate from the notification of the hazardous event.

In a preferred and non-limiting embodiment or aspect, the end-of-train computer 104 may be crash-hardened to continue to function in case of a hazardous event, such as a train derailment, to provide redundancy in the ability to directly or indirectly communicate a notification of a hazardous event, such as in the event of loss of an on-board computer 102 in the locomotive 12.

With continued reference to FIG. 1, the hazardous event alert system according to a preferred and non-limiting embodiment or aspect may include a wayside computer 106 located alongside or associated with a portion of a track. The wayside computer 106 may form part of, may include, or may be connected to another device and/or system located in or associated with the portion of the track. By way of a non-limiting example, the wayside computer 106 may form part of, may include, or may be connected to a wayside data communications device and/or system and/or an automatic train operation device and/or system. By way of another non-limiting example, the wayside computer 106 may be a separate device and/or system.

In a preferred and non-limiting embodiment or aspect, the wayside computer 106 may be in direct or indirect communication with one or more on-board computers 102, one or more end-of-train computers 104, one or more remote servers 108, 109, one or more sensors 120, and/or one or more positioning devices 122. In a preferred and non-limiting embodiment or aspect, the wayside computer 106 may directly or indirectly communicate via one or more communication devices 116.

In a preferred and non-limiting embodiment or aspect, the wayside computer 106 may directly and/or indirectly receive a notification concerning the occurrence of a parameter or condition sensed or determined from a sensor 120. In a case that a notification concerning the occurrence of a parameter or condition sensed or determined by the sensor 120 is directly or indirectly received by the wayside computer 106, the wayside computer 106 may directly or indirectly communicate a hazardous event notification to an on-board computer 102, to an end-of-train computer 104, and/or to a remote server 108 associated with a specified entity.

In the case that the wayside computer 106 directly or indirectly communicates the notification of the hazardous event to the on-board computer 102, the wayside computer 106 may directly or indirectly receive confirmation of receipt of the notification directly or indirectly communicated from the wayside computer 106 to the on-board computer 102. By way of a non-limiting example, the wayside computer 106 may receive the confirmation of receipt after communicating a request for a confirmation of receipt of the notification to the on-board computer 102. By way of another non-limiting example, the wayside computer 106 may receive the confirmation of receipt without or before communicating a request for a confirmation of receipt of the notification to the on-board computer 102.

If the wayside computer 106 does not receive confirmation of receipt of the notification of the hazardous event directly or indirectly communicated from the wayside computer 106 to the on-board computer 102, which may result due to the unavailability of the engineer, the wayside computer 106 may directly or indirectly communicate a hazardous event notification to one or more remote servers 108, 109.

In a preferred and non-limiting embodiment or aspect, a notification of a hazardous event communicated by the wayside computer 106 may push an alert to users and first responders who have an alert application installed on their mobile device. The alert may contain a location of the event, a material transported, an amount of material, and/or recommended actions to take in response to the hazardous event. In a preferred and non-limiting embodiment or aspect, a notification of a hazardous event communicated by the wayside computer 106 may result in a track restriction so that other trains would be aware of the incident and take appropriate actions.

In a preferred and non-limiting embodiment or aspect, the wayside computer 106 may directly or indirectly communicate a hazardous event notification to one or more remote servers 108, 109 before or without waiting to receive confirmation of receipt of the notification of the hazardous event directly or indirectly communicated from the wayside computer 106 to the on-board computer 102. In this circumstance, the on-board computer 102 may validate or invalidate the notification of occurrence of the hazardous event. In a preferred and non-limiting embodiment or aspect, the on-board computer 102 may further directly or indirectly communicate the validation or invalidation of the notification of occurrence of the hazardous event to a remote server 108, 109, such as previously described above.

In a preferred and non-limiting embodiment or aspect, the wayside computer 106 may receive location data from a positioning device 122, which may or may not be located in or associated with the portion of the track of the wayside computer 106. In a preferred and non-limiting embodiment or aspect, the wayside computer 106 may directly or indirectly communicate the location of the train 10 and/or the occurrence of the hazardous event to the on-board computer 102 or to a remote server 108 associated with a specified entity or a remote server 109 of a central office associated with the train 10. [41]In a preferred and non-limiting embodiment or aspect, the location data may be sent to the on-board computer 102 or the remote server 108 with the notification of the hazardous event. In another preferred and non-limiting embodiment or aspect, the location data may be sent to the on-board computer 102 or the remote server 108 separate from the notification of the hazardous event. In a preferred and non-limiting embodiment or aspect, the wayside computer 106 may facilitate the indirect communication from the on-board computer 102 to the remote server 108 or from the end-of-train computer 104 to the on-board computer 102 and/or the remote server 108 by receiving and transmitting communications.

With continued reference to FIG. 1, the one or more remote servers 108, 109 may, in preferred and non-limiting embodiments or aspects, form part of, may include, or may be connected to another device and/or system with a separate function at the specified entity. By way of a non-limiting example, the remote server may form part of, may include, or may be connected to a back office system (BOS) associated with the train, a computer aided dispatch system, an electronic train management system, and/or a web server. By way of another non-limiting example, the one or more remote servers 108, 109 may be a separate device and/or system. In a preferred and non-limiting embodiment or aspect, the remote server 108 may directly or indirectly communicate with the remote server 109 of the back office system, on-board computer 102, and/or end-of-train computer 104 via one or more communication devices 118.

In a preferred and non-limiting embodiment or aspect, the remote servers 108, 109 may directly and/or indirectly receive a notification concerning the occurrence of a parameter or condition sensed or determined from the sensor 120. By way of a non-limiting example, the remote servers 108, 109 may directly and/or indirectly receive a notification concerning the occurrence of a parameter or condition sensed or determined by the sensor 120 from an on-board computer 102, an end-of-train computer 104, and/or a wayside computer 106. In a preferred and non-limiting embodiment or aspect, the remote servers 108, 109 may directly or indirectly confirm receipt of a notification received by direct or indirect communication to the remote servers 108, 109.

In a preferred and non-limiting embodiment or aspect, when a notification concerning the occurrence of a parameter or condition sensed or determined by the sensor 120 are directly or indirectly received by the remote server 109 of the back office system, the remote server 109 may directly or indirectly communicate a hazardous event notification to another remote server 108 associated with a specified entity other than the central office associated with the train 10. In a preferred and non-limiting embodiment or aspect, a notification of a hazardous event communicated by the remote servers 108, 109 may push an alert to users and first responders who have an alert application installed on their mobile device. The alert may contain a location of the event, a material transported, an amount of material, and/or recommended actions to take in response to the hazardous event. In a preferred and non-limiting embodiment or aspect, a notification of a hazardous event communicated by the remote servers 108, 109 may result in a track restriction so that other trains would be aware of the incident and take appropriate actions.

In this case, the specified entity other than the central office associated with the train 10 may be determined based on the circumstances of the hazardous event. By way of a non-limiting example, a notification of the hazardous event may be directly or indirectly communicated to the remote server 109, and the remote server 109 of the back office system may be configured to determine one or more specified entities to contact, and directly or indirectly communicate a notification of the hazardous event to one or more other remote servers 108 associated with the one or more other specified entities. In another preferred and non-limiting embodiment or aspect, when the remote server 109 directly or indirectly communicates a hazardous event notification to one or more other remote servers 108 associated with a specified entity other than the central office associated with the train 10, the remote server 109 may directly or indirectly communicate to the specified entity by other methods, such as phone calls or text messages.

In a preferred and non-limiting embodiment or aspect, the remote server 109 may directly or indirectly communicate the notification of the hazardous event to a remote server 108 of another specified entity before or after validation or invalidation or without validation or invalidation. In a preferred and non-limiting embodiment or aspect, the occurrence of the hazardous event may be validated before directly or indirectly communicating the notification of the hazardous event to a remote server 108 associated with a specified entity. In the case that the occurrence of a hazard event is neither validated nor invalidated, the remote server 109 may directly or indirectly communicate the notification of the hazardous event to another remote server 108 associated with a specified entity.

For validation, one or more of the remote servers 108, 109 may validate or invalidate the occurrence of a hazardous event by validating or invalidating the occurrence of the hazardous event based on directly or indirectly communicating with an engineer of the train 10 and/or by validating or invalidating the occurrence of the hazardous event with other information, such as by receiving a notification of at least one parameter or condition sensed or determined by a second sensor 120 on a same or different railcar 14 as the first sensor 120 from which a notification of at least one parameter or condition was received.

In a preferred and non-limiting embodiment or aspect, one or more of the remote servers 108, 109 may validate or invalidate the occurrence of the hazardous event based on directly or indirectly communicating with an engineer of the train 10 by directly or indirectly communicating a notification of an occurrence of a parameter or condition sensed or determined by the sensor 120 to an engineer of the train 10 via an output device associated with the locomotive or the engineer. In another preferred and non-limiting embodiment or aspect, the remote server 108 may further request validation or invalidation from the engineer of the occurrence of a hazardous event via an input device associated with the locomotive or the engineer. If validation of the occurrence of the hazardous event is received via the input device, then the remote server 109 may directly or indirectly communicate a notification of the hazardous event to a remote server 108 associated with a specified entity as described above. If no validation or invalidation of the occurrence of the hazardous event is received via the input device, which may result due to the unavailability of the engineer, then the remote server 109 may directly or indirectly communicate a notification of a hazardous event to another remote server 108 associated with a specified entity.

In a preferred and non-limiting embodiment or aspect, the remote server 109 may receive a notification of an occurrence of a hazardous event from an engineer of the train 10 via an input device associated with the locomotive or the engineer without receiving a notification concerning the occurrence of a parameter or condition sensed or determined by the sensor 120. In another preferred and non-limiting embodiment or aspect, the remote server 109 may further directly or indirectly communicate the notification of the hazardous event to another remote server 108 of a specified entity.

In another preferred and non-limiting embodiment or aspect, one or more of the remote servers 108, 109 may receive a notification of a hazardous event from an end-of-train computer 104 or a wayside computer 106. By way of non-limiting examples, the notification of a hazardous event from an end-of-train computer 104 or a wayside computer 106 may be received before or after validation of the occurrence of the hazardous event or may be received before or after confirmation of receipt of a notification of the hazardous event directly or indirectly communicated from the end-of-train computer 104 or the wayside computer 106 to the on-board computer 102 was not received from the on-board computer 102 to the end-of-train computer 104 or the wayside computer 106, which may result due to the unavailability of the engineer.

In a preferred and non-limiting embodiment or aspect, one or more of the remote servers 108, 109 may include a database of hazardous event categories. The hazardous event categories may include but are not limited to any hazardous event category that is required, encouraged, and/or accepted by a specified entity, such as a federal government authority, a state government authority, a local government authority, a central office associated with the train, another train, a central office associated with another train, a maintenance entity, a medical entity, a search and rescue entity, a state police, a local police, an agency related to homeland security, or any combination thereof. In a preferred and non-limiting embodiment or aspect, the hazardous event categories may include but are not limited to a category for a train collision event and/or a category for a train derailment event. In a preferred and non-limiting embodiment or aspect, the on-board computer may determine the specified entity to be contacted based on the category of the hazardous event. In preferred and non-limiting embodiments or aspects, the remote server 109 associated with the back office system of the train may communicate an identity of the hazardous event with the notification of the hazardous event, or the identity of the hazardous event may be sent separately.

In a preferred and non-limiting embodiment or aspect, one or more of the remote servers 108, 109 may include a database of predetermined hazardous event severity categories. The severity categories may include any severity category that is required, encouraged, and/or accepted by a specified entity, such as a federal government authority, a state government authority, a local government authority, a central office associated with the train, another train, a central office associated with another train, a maintenance entity, a medical entity, a search and rescue entity, a state police, a local police, an agency related to homeland security, or any combination thereof. For example, a severity may be based on a number railcars affected by the hazardous event, a location of the hazardous event, a type of track at the location of the hazardous event, a grade of the land at the location of the hazardous event, and/or a proximity to persons and/or structures potentially affected at the location of the hazardous event. In a preferred and non-limiting embodiment or aspect, the severity may be based on a number of railcars affected by the hazardous event, which may be determined by a number of sensors sensing or determining the at least one parameter or condition. In another preferred and non-limiting embodiment or aspect, the severity may be based on whether the railcar 14 remains upright, such as after derailment or collision, which may be determined by a parameter or condition sensed or determined by at least one sensor 120. In a preferred and non-limiting embodiment or aspect, the remote server 109 may determine the specified entity to be contacted based on an identified severity of the hazardous event. In preferred and non-limiting embodiments or aspects, the remote server 109 associated with back office system of the train may communicate the severity of the hazardous event with the notification of the hazardous event, or the severity of the hazardous event may be sent separately.

In a preferred and non-limiting embodiment or aspect, one or more of the remote servers 108, 109 may directly or indirectly receive location data from the positioning device 122, which may or may not be located in or associated with the locomotive 12. In a preferred and non-limiting embodiment or aspect, the remote server 109 may determine the specified entity to be contacted based on the location of the occurrence of the hazardous event. In a preferred and non-limiting embodiment or aspect, the remote server 108 may also directly or indirectly communicate the location of the train 10 and/or the occurrence of the hazardous event to another remote server 108 associated with another specified entity. In a preferred and non-limiting embodiment or aspect, the location data may be sent to the other remote server 108 with the notification of the hazardous event or may be sent separately.

In a preferred and non-limiting embodiment or aspect, one or more of the remote servers 108, 109 may include a database of pre-determined communications to be made in the event of a hazardous event. In a preferred and non-limiting embodiment or aspect, the database of pre-determined communications to be made may include any communication that is required, encouraged, and/or accepted by a specified entity, such as a federal government authority, a state government authority, a local government authority, a central office associated with the train, another train, a central office associated with another train, a maintenance entity, a medical entity, a search and rescue entity, a state police, a local police, an agency related to homeland security, or any combination thereof. In a preferred and non-limiting embodiment or aspect, the database of pre-determined communications may include contact information for railroads and first responders so that appropriate parties within the location of or for the category and/or severity of the hazardous event are contacted in the event of a hazardous event.

In a preferred and non-limiting embodiment or aspect, the database of pre-determined communications may predetermine the specific entities to be contacted based one or more parameters or conditions related to the hazardous event, which may include but is not limited to the category of the hazard event, the severity of the hazardous event, and/or the location of the hazardous event.

In a preferred and non-limiting embodiment or aspect, one or more of the remote servers 108, 109 may include an event log in the form of a data storage device and/or system. By way of a non-limiting example, the event log may record the occurrence of a parameter or condition sensed or determined by a sensor 120, a notification based on a parameter or condition sensed or determined by a sensor 120, a validated hazardous event, an invalidated hazardous event, and/or a notification of a hazardous event received from an engineer of the train 10 via an input device.

In a preferred and non-limiting embodiment or aspect, one or more of the remote servers 108, 109 may include a materials storage log in the form of a data storage device and/or system. By way of a non-limiting example, the materials storage log may record the type of hazardous materials being transported, how much of the materials is being transported, and/or how to properly respond to the hazardous event for the given hazardous material. In preferred and non-limiting embodiments or aspects, the remote server 108 associated with a central office of the train may communicate at least a portion of the materials storage data with the notification of the hazardous event, or the portion of the materials storage data may be sent separately.

With continued reference to FIG. 1, in a preferred and non-limiting embodiment or aspect, the hazardous event alert system may include one or more sensors 120. The sensors 120 may be located at or associated with a locomotive 12 of the train 10, one or more railcars 14 of the train 10, and/or the end-of-train computer 104. In a preferred and non-limiting embodiment or aspect, the sensors 120 may form part of, may include, or may be connected to an on-board computer 102, an end-of-train computer 104, a wayside computer 106, a remote server 108, and/or a positioning device 122. In a preferred and non-limiting embodiment or aspect, the sensors 120 may be in direct or indirect communication with one or more on-board computers 102, one or more end-of train computers 104, one or more end-of-train computers 106, one or more remote servers 108, one or more sensors 120 and/or one or more additional positioning devices 122. In a preferred and non-limiting embodiment or aspect, a sensor 120 may be attached or installed on a locomotive, a railcar, end-of-train computer, or other portions of the train 10.

In a preferred and non-limiting embodiment or aspect, a sensor 120 may be magnetic and/or adhere to a locomotive or railcar. In preferred and non-limiting embodiments or aspects, the sensor 120 includes a sensing device and a communications device, and is configured to communicate data from the sensing device to the on-board computer 102, the end-of-train computer 104, another sensor 120, and/or a remote server or device. The communications device may be wired or wireless, and the data communicated may indicate that the sensor detected a hazardous event, such as a derailment, or that it received a message of such a hazardous event. In a preferred and non-limiting embodiment or aspect, a sensor 120 may sense or determine the occurrence of a derailment and/or a collision.

In a preferred and non-limiting embodiment or aspect, a sensor 120 may include a mobile or stationary device that has capabilities for sensing or determining a vertical and/or lateral acceleration and/or other movement of the train 10 or portion of the train 10. A system, method, and apparatus for detecting the varying acceleration of a railcar is shown in U.S. Pat. No. 8,914,162 to Kernwein et al., entitled "System, Method, and Apparatus to Detect and Report Track Structure Defects", which is incorporated by reference herein in its entirety.

In a preferred and non-limiting embodiment or aspect, a sensor 120 may include an accelerometer, such as an accelerometer that is part of a navigation system or an accelerometer purposed for detecting track defects and/or hazardous events. In a preferred and non-limiting embodiment or aspect, a sensor 120 may include a pressure sensor, such as for monitoring brake pipe pressure. In a preferred and non-limiting embodiment or aspect, a sensor 120 may include a rotational sensor. In a preferred and non-limiting embodiment or aspect, a sensor 120 may include a battery and wireless sensors. In a preferred and non-limiting embodiment or aspect, a sensor 120 may include a wireless radio for communicating. In a preferred and non-limiting embodiment or aspect, one or more sensors 120 may communicate with each other to directly or indirectly pass messages to an on-board computer 102, an end-of-train computer 104, a wayside computer 106, and/or a remote server 108. In a preferred and non-limiting embodiment or aspect, one or more sensors 120 may communicate a notification that at least one parameter or condition associated with a hazardous event is sensed or determined.

With continued reference to FIG. 1, in a preferred and non-limiting embodiment or aspect, the hazardous event alert system may include one or more positioning devices 122. In a preferred and non-limiting embodiment or aspect, a positioning device 122 may be located at or associated with a locomotive 12 of the train 10, one or more railcars 14 of the train 10, or a portion of the track. In a preferred and non-limiting embodiment or aspect, the positioning device 122 may form part of, may include, or may be connected to an on-board computer 102, an end-of-train computer 104, a wayside computer 106, a remote server 108, and/or a sensor 120. In a preferred and non-limiting embodiment or aspect, the positioning device 122 may form part of, may include, or may be connected to a Global Positioning System (GPS) for sensing or determining a location or position of at least a portion of the train. In a preferred and non-limiting embodiment or aspect, the positioning device 122 may determine location based on a stationary marker, such as a milepost marker, based on velocity data, and/or based on information received from a wayside computer 106. In a preferred and non-limiting embodiment or aspect, the positioning devices 122 may be in direct or indirect communication with one or more on-board computers 102, one or more end-of train computers 104, one or more wayside computers 106, one or more remote servers 108, 109, one or more sensors 120, and/or one or more additional positioning devices 122.

In a preferred and non-limiting embodiment or aspect, the hazardous alert system may further include a web portal. The web portal may be an interface through which railroads may define users and actions. By way of a non-limiting example, the web portal may display alerts and report events. In a preferred and non-limiting embodiment or aspect, the hazardous alert system may further include a computer application, such as a smart phone application, through which users may receive push notifications. By way of a non-limiting example, the push notifications may depend on the role of the users, such as whether the users are associated with the railroad for the train 10 or is associated with another specified entity, such as a first responder.

Figure 2:
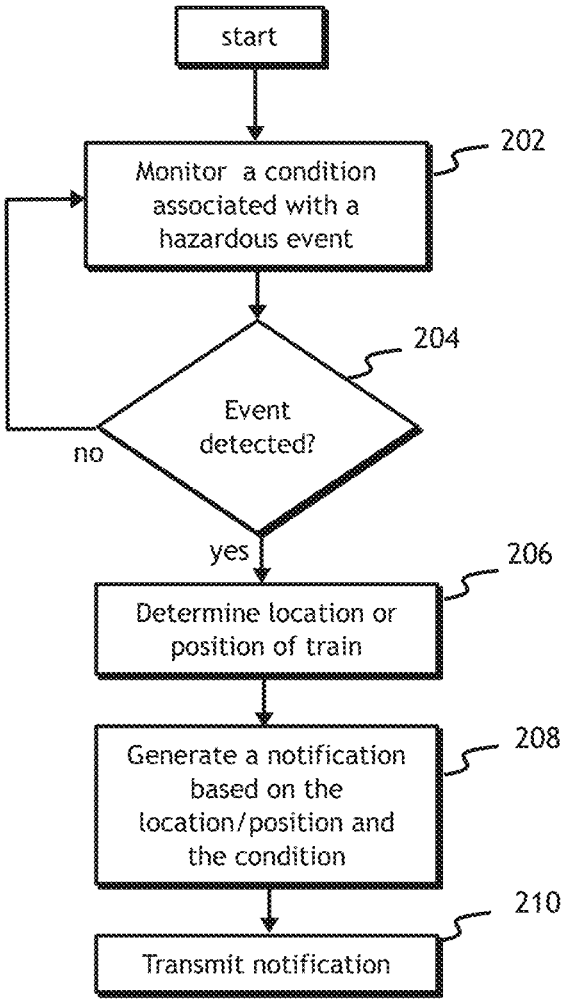
FIG. 2 illustrates a step diagram for a hazardous event alert method according to a preferred and non-limiting embodiment or aspect.

Referring now to FIG. 2, a step diagram for a hazardous event alert method is shown according to a preferred and non-limiting embodiment or aspect. At a first step 202, at least one parameter or condition associated with a hazardous event is monitored. As described herein, a condition may include, for example, a change in brake pipe pressure, a detection of tilt or vertical acceleration, and/or the like. A hazardous event may include, but is not limited to, a derailment of one or more railcars of a train. At a next step 204, the data being monitored is processed to detect an occurrence of a hazardous event. If a hazardous event is not detected, the method proceeds back to step 202 and the parameter or condition continues to be monitored. If a hazardous event is detected, the method proceeds to step 206 and the location or position of the train is determined. Since a hazardous event was previously detected, the then-current location or position of the train is also the location or position of the hazardous event. At a next step 208, a notification is generated based on the parameter or condition and the location or position of the train. At step 210, the notification is transmitted to a back office server, a specified entity, or any other remote server and/or device.

Figure 3:
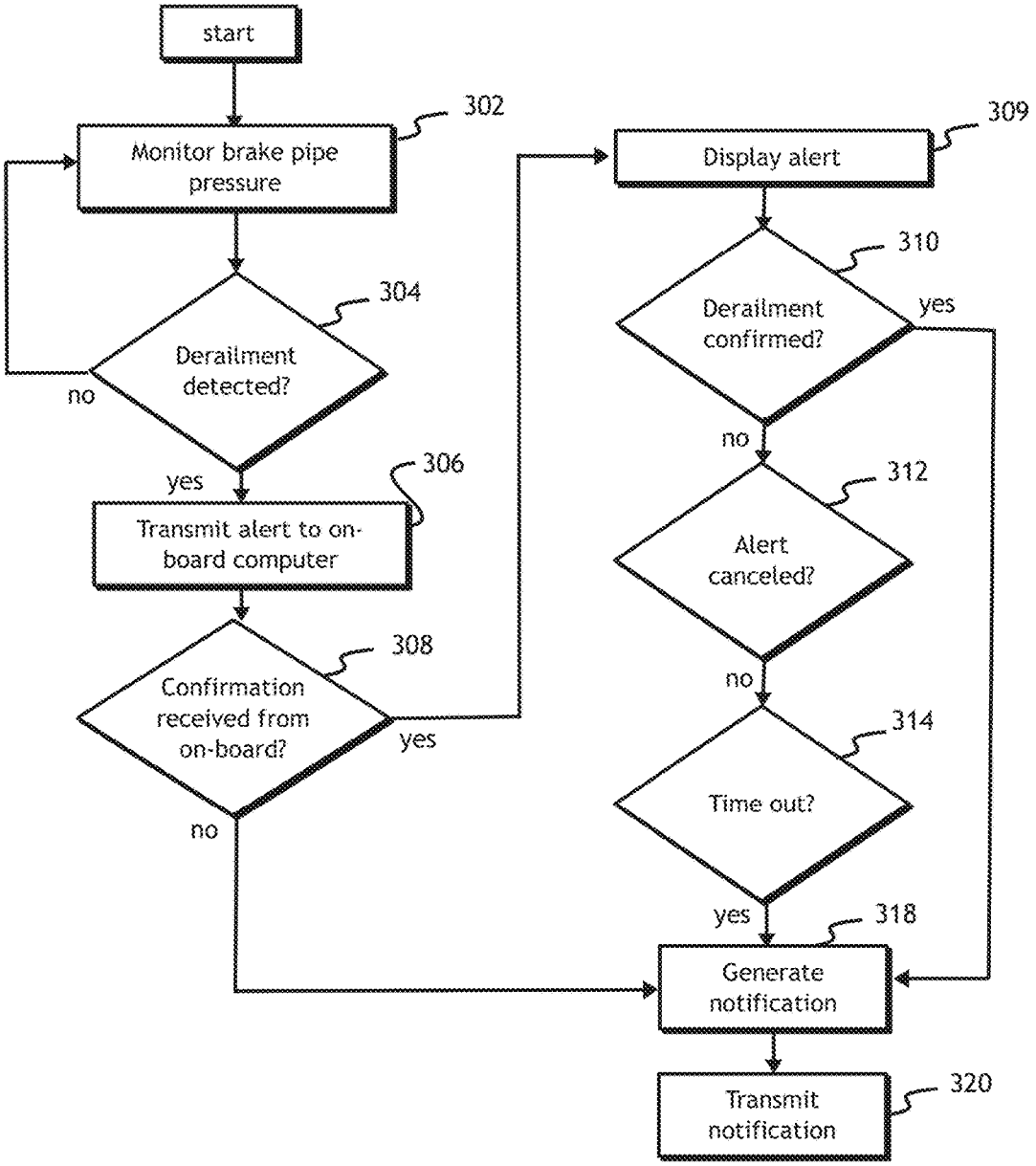
FIG. 3 illustrates a step diagram for a hazardous event alert method according to another preferred and non-limiting embodiment or aspect.

Referring to FIG. 3, a step diagram for a hazardous event alert method is shown according to another preferred and non-limiting embodiment or aspect. At a first step 302, the brake pipe pressure is monitored at the end-of-train computer. It will be appreciated, however, that various other parameters or conditions may be monitored by various different devices and systems. At a next step 304, it is determined whether a derailment has been detected based on the monitored brake pipe pressure. Various other hazardous events may also be detected in non-limiting embodiments. Next, an alert is transmitted to an on-board computer at step 306. After the alert is transmitted to the on-board computer at step 306, the method proceeds to step 308 where it is determined whether a confirmation was received from the on-board computer in response to the alert. If a confirmation is not received, the end-of-train computer may assume that a communication error has occurred due to a derailment or other hazardous event and the method may proceed to step 318 to generate a notification and step 320 to transmit the notification. The hazardous event notification may include various types of information including, for example, the detected parameter or condition, the position or location of the train, the type of hazardous material being transported, a date and/or time, an identification of the train and/or locomotive, and/or any other information available to the on-board computer, end-of-train computer, or head-end-unit.

With continued reference to FIG. 3, if a confirmation is received from the on-board computer at step 308, the method proceeds to step 309 and an indication of an alert is displayed to an operator of the train. The indication may present the operator with one or more options. In a preferred and non-limiting embodiment or aspect, the operator is provided with an option to confirm the hazardous event or parameter or condition and an option to cancel the alert (e.g., invalidate the hazardous event or parameter or condition). At step 310 it is determined whether the operator confirmed the occurrence of a derailment or other hazardous event. If a confirmation is received from the operator, the method proceeds to step 318 and a hazardous event notification is generated.

Still referring to FIG. 3, if a confirmation is not received at step 310 and the alert is cancelled at step 312, the method may end or, in some non-limiting embodiments or aspects, may proceed to step 318 to generate the notification. However, in such circumstances, the notification transmitted at step 320 may be transmitted to only a back office system and other transmissions may be limited or not occur at all. For example, if a derailment is confirmed at step 310, the notification generated in step 318 may be transmitted at step 320 to a back office server, to various mobile devices, and to a specified entity (e.g., a governmental or regulatory agency). However, if the derailment is not confirmed at step 310 and the alert is cancelled at step 312, the notification generated in step 318 may be transmitted to only the back office system and one or more mobile devices for recordation or other purposes, but not to the specified entity. If the derailment is not confirmed at step 310 and the alert is not cancelled at step 312, at step 314 it is determined if a predetermined time period has lapsed. If the time period has elapsed without a response from the operator of the train, it may be assumed as a default that a hazardous event has occurred and the method proceeds to step 318 and then to step 320. In this circumstance, the notification generated in step 318 may be transmitted to the back office system, various mobile devices, and a specified entity, as an example.

Although the invention has been described in detail for the purpose of illustration based on what is currently considered to be the most practical and preferred embodiments or aspects, it is to be understood that such detail is solely for that purpose and that the invention is not limited to the disclosed embodiments or aspects, but, on the contrary, is intended to cover modifications and equivalent arrangements that are within the spirit and scope of the description. For example, it is to be understood that the present invention contemplates that, to the extent possible, one or more features of any embodiment can be combined with one or more features of any other embodiment or aspect.

What is claimed is:

1. A hazardous event alert system for a train, the hazardous event alert system comprising:

at least one sensor positioned on or associated with the train and configured to sense or monitor at least one parameter or condition;

at least one communication device positioned on or associated with the train and programmed or configured to receive, process, and/or transmit data;

at least one positioning system programmed or configured to detect a location or position of at least a portion of the train; and at least one computer positioned on or associated with the train and in communication with the at least one sensor, the at least one communication device, and the at least one positioning system, wherein the at least one computer is programmed or configured to:

determine that a hazardous event occurred based at least partially on data generated by the at least one sensor;

determine or receive the location or position of the at least a portion of the train from the at least one positioning system;

generate a hazardous event notification based at least partially on the at least one condition and the location or position of the at least a portion of the train; and communicate the hazardous event notification to at least one of a back office system and at least one remote server associated with at least one specified entity.

2. The hazardous event alert system of claim 1, wherein the at least one specified entity includes at least one of the following: a federal government authority; a state government authority; a local government authority; a maintenance entity; a medical entity; a search and rescue entity; a state police; a local police; an agency related to homeland security; or any combination thereof.

3. The hazardous event alert system according to claim 1, wherein the at least one sensor is at least one of the following: a rotational sensor; a gyroscope; an accelerometer; a pressure sensor; or any combination thereof.

4. The hazardous event alert system according to claim 1, wherein the at least one computer comprises:

an end-of-train computer located in or on the train and in communication with the at least one sensor; and an on-board computer located in or associated with a locomotive of the train and in communication with the at least one end-of-train computer.

5. The hazardous event alert system according to claim 4, wherein the at least one sensor comprises a pressure sensor adapted to monitor brake pipe pressure, and wherein the end-of-train computer is programmed or configured to determine that the at least one condition has occurred based on the brake pipe pressure.

6. The hazardous event alert system according to claim 1, wherein at least one of an end-of-train computer and the at least one sensor is programmed or configured to transmit an alert to an on-board computer in response to the at least one parameter or condition being detected, and wherein the at least one on-board computer is programmed or configured to:

display an alert to an operator of the train in response to the at least one condition being detected; and receive an input from the operator confirming or invalidating the occurrence of the hazardous event.

7. The hazardous event alert system according to claim 6, wherein at least one of the following: the end-of-train computer, the on-board computer, the at least one sensor, or any combination thereof is further programmed or configured to communicate the hazardous event notification to the at least one remote server associated with the at least one specified entity in response to determining at least one of the following:

(a) that the input is not received by the on-board computer within a predetermined time period;

(b) that the input confirms the occurrence of the hazardous event;

(c) that a communication error occurred between the on-board computer and at least one of the end-of-train computer and the at least one sensor; or (d) any combination thereof.

8. The hazardous event alert system according to claim 6, wherein the at least one computer is further programmed or configured to communicate the hazardous event notification to the back office system but not the at least one remote server associated with the at least one specified entity in response to determining that the input invalidates the occurrence of the hazardous event.

9. The hazardous event alert system according to claim 1, wherein the at least one computer is further programmed or configured to identify or receive identification of the at least one specified entity to receive the hazardous event notification based at least partially on at least one of the following: the location or position of an occurrence of a hazardous event, a category of the hazardous event, a severity of the hazardous event, an identity of a hazardous material being transported by the train, or any combination thereof.

10. The hazardous event alert system according to claim 1, wherein the at least one sensor comprises:

a sensing device configured to sense or monitor the at least one parameter or condition; and a communications device configured to transmit data associated with the at least one parameter or condition to at least one of the at least one computer and at least one other sensor.

11. The hazardous event alert system according to claim 1, wherein the at least one sensor is removably attachable to at least a portion of at least one railcar of the train.

12. A computer-implemented hazardous event alerting method for a train having at least one sensor, at least one communication device, at least one positioning system, and at least one processor, the method comprising:

detecting at least one parameter or condition associated with a hazardous event with the at least one sensor;

detecting a position or location of the train with the at least one positioning system;

determining, with the at least one processor, that the hazardous event occurred based at least partially on at least one of the following: determining that a manual confirmation input is received from an operator of the train, determining that a manual confirmation input is not received from the operator of the train within a predetermined time period, determining a communication error between an on-board computer and at least one of an end-of-train computer and the at least one sensor, or any combination thereof;

generating a hazardous event notification based at least partially on the at least one condition and the position or location of the train; and transmitting the hazardous event notification to at least one remote server.

13. The computer-implemented method of claim 12, wherein the hazardous event is a train derailment.

14. The computer-implemented method of claim 12, further comprising transmitting an alert from at least one of the end-of-train computer and the at least one sensor to the on-board computer in response to detecting the at least one condition, wherein the communication error is determined if a confirmation message is not received from the on-board computer by at least one of the end-of-train computer and the at least one sensor in response to the alert.

15. The computer-implemented method of claim 12, wherein the at least one sensor is at least one of the following: a rotational sensor; a gyroscope; an accelerometer; a pressure sensor; or any combination thereof.

16. The computer-implemented method of claim 12, wherein the at least one sensor comprises a pressure sensor adapted to monitor brake pipe pressure, and wherein the at least one parameter or condition is detected based on the brake pipe pressure.

17. The computer-implemented method of claim 12, wherein the at least one remote server comprises a back office system and at least one remote server associated with at least one specified entity.

18. The computer-implemented method of claim 17, further comprising identifying the at least one specified entity based at least partially on at least one of the following: the position or location of a hazardous event, a category of the hazardous event, a severity of the hazardous event, an identity of a hazardous material being transported by the train, or any combination thereof.

19. The computer-implemented method of claim 12, wherein the end-of-train computer monitors the at least one parameter or condition associated with the hazardous event and detects the at least one parameter or condition, wherein the on-board computer displays the alert to the operator of the train, and wherein at least one of the following: the end-of-train computer, the on-board computer, the at least one sensor, or any combination thereof, determines if the operator confirmed or cancelled the alert, generates the hazardous event notification, and transmits the hazardous event notification.

20. A computer program product comprising at least one non-transitory computer-readable medium including program instructions that, when executed by at least one computer including at least one processor, causes the at least one computer to:

detect at least one parameter or condition associated with a hazardous event with at least one sensor located on or in a train;

determine a position or location of the train with at least one positioning system;

determine that the hazardous event occurred based at least partially on at least one of the following: (a) determining that a manual confirmation input is received from an operator of the train, (b) determining that a manual confirmation input is not received from the operator of the train within a predetermined time period, (c) determining a communication error between an on-board computer and at least one of an end-of-train computer and the at least one sensor, or any combination thereof;

generate a hazardous event notification based at least partially on the at least one parameter or condition and the position or location of the train; and transmit the hazardous event notification to at least one remote server.

21. The computer program product of claim 20, wherein the hazardous event is a train derailment.

22. The computer program product of claim 20, wherein the program instructions, when executed by the at least one computer, further cause the at least one computer to transmit an alert from at least one of the at least one sensor and the end-of-train computer to the on-board computer in response to detecting the at least one parameter or condition, wherein the communication error is determined if a confirmation message is not received by the at least one of the at least one sensor and the end-of-train computer from the on-board computer in response to the alert.

23. The computer program product of claim 20, wherein the at least one sensor is at least one of the following: a rotational sensor; a gyroscope; an accelerometer; a pressure sensor; or any combination thereof.

24. The computer program product of claim 20, wherein the at least one sensor comprises a pressure sensor adapted to monitor brake pipe pressure, and wherein the at least one condition is detected based on the brake pipe pressure.

25. The computer program product of claim 20, wherein the at least one remote server comprises a back office system and at least one remote server associated with at least one specified entity.

26. The computer program product of claim 20, wherein the program instructions, when executed by the at least one computer, further cause the at least one computer to identify the at least one specified entity based at least partially on at least one of the following:

the location or position of a hazardous event, a category of the hazardous event, a severity of the hazardous event, an identity of a hazardous material being transported by the train, or any combination thereof.

27. A system for generating a hazardous event notification on a train, comprising:

(a) an end-of-train computer in communication with at least one sensor, the end-of-train computer programmed or configured to:

(i) detect, with the at least one sensor, at least one parameter or condition associated with a hazardous event; and (ii) transmit an alert to an on-board computer in response to detecting the at least one parameter or condition; and (b) the on-board computer programmed or configured to:

(i) receive the alert from the end-of-train computer;

(ii) display an indication of the alert to an operator of the train in response to receiving the alert; and (iii) receive, from the operator of the train, an input confirming the alert or cancelling the alert;

wherein at least one of the end-of-train computer and the on-board computer is further programmed or configured to:

(i) determine that the hazardous event occurred in response to: determining that the input confirmed the alert, determining that the input is not received within a predetermined time period, or determining that the end-of-train computer did not receive a confirmation from the on-board computer after transmitting the alert;

(ii) generate the hazardous event notification based at least partially on the at least one condition and a location or position of the train when the at least one condition is detected; and (iii) transmit the hazardous event notification to at least one remote server.

28. The system of claim 27, wherein the at least one remote server comprises at least one server associated with a governmental or regulatory agency and a back office system, and wherein the hazardous event notification is transmitted to the back office system but not the at least one server associated with the governmental or regulatory agency if the input cancels the alert.

* * * * *